US008376347B2

(12) United States Patent
Idehara

(10) Patent No.: US 8,376,347 B2
(45) Date of Patent: Feb. 19, 2013

(54) CONVEYANCE MECHANISM AND IMAGE FORMING APPARATUS INCORPORATING SAME

(75) Inventor: Ryoh Idehara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/290,259

(22) Filed: Nov. 7, 2011

(65) Prior Publication Data

US 2012/0119430 A1 May 17, 2012

(30) Foreign Application Priority Data

Nov. 15, 2010 (JP) ..... 2010-255252
Jul. 19, 2011 (JP) ..... 2011-158096

(51) Int. Cl.
*B65H 5/22* (2006.01)
*B65H 83/00* (2006.01)
*B65H 85/00* (2006.01)

(52) U.S. Cl. ..... 271/3.14; 271/902

(58) Field of Classification Search ..... 271/3.14, 271/902; 347/104
See application file for complete search history.

(56) References Cited

U.S. PATENT DOCUMENTS 6,130,762 A * 10/2000 Hwang et al. ..... 358/498
7,587,166 B2 9/2009 Aono
8,020,848 B2 9/2011 Kita et al.
2010/0096794 A1* 4/2010 Watanabe ..... 271/3.14
2010/0225043 A1* 9/2010 Otobe ..... 271/3.14

FOREIGN PATENT DOCUMENTS

JP 2006-16188 1/2006

* cited by examiner

*Primary Examiner* — David H Bollinger
(74) *Attorney, Agent, or Firm* — Cooper & Dunham LLP

(57) ABSTRACT

An image forming apparatus comprises a sheet feeding cassette, a printing unit, and a sheet ejection tray. A first conveyance unit feeds the recording sheet from a front side of the sheet feeding cassette and inverts and conveys it to the printing unit. A path of a switchback conveyance unit extends from the printing unit to let the recording sheet switch back after the printing in an opposite direction to that the recording sheet is conveyed to the printing unit. A front and back side inversion conveyance unit conveys the printing sheet to the sheet ejection tray with a printed surface of the printing sheet facing down. Both of the sheet feeding position on the conveyance unit and the front and back side inversion conveyance unit are arranged on the front side in the image forming apparatus.

19 Claims, 7 Drawing Sheets

CONVEYANCE MECHANISM AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2010-255252, filed on Nov. 15, 2010, in the Japanese Patent Office, and Japanese Patent Application No. 2011-158096, filed on Jul. 19, 2011, in the Japanese Patent Office, and the entire disclosure of which is hereby incorporated herein by reference.

TECHNICAL FIELD

This disclosure relates to a printing sheet conveyance mechanism enabling a front side operation of a user, and an image forming apparatus, such as a copier, a printer, a facsimile machine, a multifunctional machine combining these devices, etc., employing the printing sheet conveyance mechanism.

DESCRIPTION OF THE BACKGROUND ART

As is well know, an image forming apparatus, such as a copier, a printer, a facsimile machine, a multifunctional machine combining these devices, etc., utilizes a printing head having one or more liquid droplet ejection heads to eject liquid drops, such as ink, etc. Alternatively, an image forming apparatus employs an electrophotographic system and renders a latent image visible by supplying developer thereto. Specifically, the former liquid droplet ejection system forms an image by ejecting and adhering or impregnating liquid drops onto a recording medium, such as a recording sheet, etc., while conveying the recording medium.

Further, it is important for an image forming apparatus equipped with a liquid droplet ejection device to maintain and apply negative pressure to ink in a liquid droplet ejection head (i.e., pressure applied to ink needs to be kept negative in a liquid droplet ejection head) for the purpose of stabilizing ink ejection from the liquid droplet ejection head. For this reason, a negative pressure generator is generally included in an ink supply system that supplies ink to the liquid droplet ejection head. Thus, the ink is supplied to the liquid droplet ejection head under the negative pressure being applied by the negative pressure applicator.

By contrast, the latter image forming apparatus employing an electrophotographic process generally applies charging, exposing, developing, and transferring processes to a photoconductor serving as an image bearer, thereby forming an image thereon. A latent image formed on the photoconductor is then rendered visible by a developing device and is transferred onto a recording medium as a visual toner image.

Hence, in both of the liquid droplet ejection device and the electrophotographic system, a copy is obtained by forming an image on the recording medium. A recording sheet as one type of recording media is either conveyed from a sheet feeding cassette or a manual sheet feeding tray other than the sheet feeding cassette. A sheet feeding cassette system capable of feeding multiple recording sheets stacked in a sheet feeding cassette therefrom one by one is known, in which, for example, a mounting plate is provided in a body of the sheet feeding cassette to displace a leading end of the recording sheet toward an feeding roller, so that the feeding roller can feed a top most recording sheet contacting thereto among those stacked on the mounting plate.

Further, it is demanded these days that replacement of the above-described sheet feeding cassette and removal of printed sheets can be performed from the front of an apparatus body to improve usability. To fulfill such demand, it is attempted that a manual sheet feeding tray and a sheet ejection tray are provided above a detachably attached section for the sheet feeding cassette, as disclosed in Japanese Patent Application Publication No. 2006-16188 (JP-2006-16188-A). Specifically, it is disclosed in JP-2006-16188-A that recording sheets stacked on a sheet feeding cassette inserted from a front side of an ink jet printing system equipped with a liquid droplet ejection device are fed one by one from a rear side of the sheet feeding cassette, are conveyed by a conveyance belt to receive printing while facing a printing unit, and are then ejected onto a sheet ejection tray. Also disclosed in JP-2006-16188-A is an inversion conveyance path connected to a conveyance path, which is connected to the printing unit, at the rear side in the sheet feeding cassette to invert and convey the recording sheet toward the printing unit for printing on another side.

By arranging structural members of such operation objectives on the front side surface of the apparatus as shown in JP-2006-16188-A, operations to be executed at the rear side of the apparatus and hardly reachable by hand can be omitted. However, new problems arise. Specifically, since the inversion conveyance path protrudes outside the apparatus body equipped with the sheet feeding cassette, the footprint of the apparatus as a whole increases.

Further, since an feeding position where the recording sheet is fed from a sheet feeding cassette is at a rear side in the sheet feeding cassette installed in the apparatus (i.e., an opposite side to the front side of the apparatus), removal of a jammed sheet needs to be performed at the rear side, thereby degrading usability in comparison with that performed at the front side. Further, the recording sheet fed from the sheet feeding cassette and then subjected to a printing process is ejected onto the sheet ejection tray as is. However, since an image surface of the printing sheet ejected on the sheet ejection faces upward and subsequent recording sheets are similarly stacked thereon, a printing order of the recording sheets stacked on the sheet ejection tray is inconsistent with a page number order of those as a result.

BRIEF SUMMARY

Accordingly, in an aspect of this disclosure, there is provided a novel image forming apparatus that comprises a main body, a sheet feeding cassette detachably attached to the main body in a back and forth direction thereof accommodating recording sheets, a printing unit that executes printing onto the recording sheet. A sheet ejection tray is provided to receive a printed sheet from the printing unit. A first conveyance unit is provided to feed the recording sheet from a front side of the sheet feeding cassette attached to the image forming apparatus at a sheet feeding position. The conveyance unit inverts and further conveys the recording sheet fed from the sheet feeding cassette to the printing unit. A switchback conveyance unit extends from the printing unit to let the recording sheet switch back after the printing in the printing unit in an opposite direction to that the recording sheet is conveyed to the printing unit. A front and back side inversion conveyance unit is provided to convey the printing sheet passing through the switchback conveyance unit to the sheet ejection tray with a printed surface of the printing sheet facing down. Both of the sheet feeding position on the conveyance unit and the front and back side inversion conveyance unit are arranged on the front side in the image forming apparatus.

In another aspect, the switchback conveyance unit has a detour extending upwardly within the main body at downstream of the printing unit.

In yet another aspect, a partially openably closable front side wall unit is provided to allow manual access to the feeding position of the conveyance unit and the front and back side inversion conveyance unit when it is partially opened.

In yet another aspect, the front side wall unit further includes a bypass sheet feeding unit to feed a recording sheet from another source than the sheet feeding cassette. The bypass sheet feeding unit has a path converging with a path of the first conveyance unit extending from the sheet feeding cassette to convey the recording sheet therefrom. A bypass sheet ejection unit is further included in the front side wall unit to eject the recording sheet onto another destination than the sheet ejection tray. The bypass sheet ejection unit branches off from a path of the front and back side inversion conveyance unit.

In yet another aspect, a bifurcation member is disposed at a confluence where a path of the first conveyance unit and that of switchback conveyance unit converge. The bifurcation member switches a conveyance direction of the recording sheet from the printing unit side to the front and back side inversion conveyance unit side vice versa in accordance with a printing progress.

In yet another aspect, a sheet ejection destination switching device is posed at a confluence where a path of the front and back side inversion conveyance unit and that of the bypass sheet ejection unit converge. The sheet ejection destination switching device switches a conveyance direction of the recording sheet from the sheet ejection tray side to the bypass sheet ejection unit side vice versa in accordance with a printing mode.

In yet another aspect, the bypass sheet ejection unit has an openably closable bypass cover and is attached to the wall unit. The bypass sheet ejection unit has a conveyance path connecting to the path of the front and back side inversion conveyance unit when the bypass cover is opened.

In yet another aspect, a pair of sheet feeding rollers is provided to sandwich and convey the recording sheet in multiple directions. The pair of sheet feeding rollers has a commonly used roller arranged between a path of the first conveyance unit and that of the front and back side inversion conveyance unit, and two opposed rollers respectively arranged on the paths of the conveyance unit and the front and back side inversion conveyance unit.

BRIEF DESCRIPTION OF THE DRAWINGS

A complete appreciation of this disclosure and many of the attendant advantages thereof will be more readily obtained as the same becomes better understood by reference to the following detailed description when considered in connection with the accompanying drawings, wherein.

DETAILED DESCRIPTION OF THE INVENTION

Figure 1:
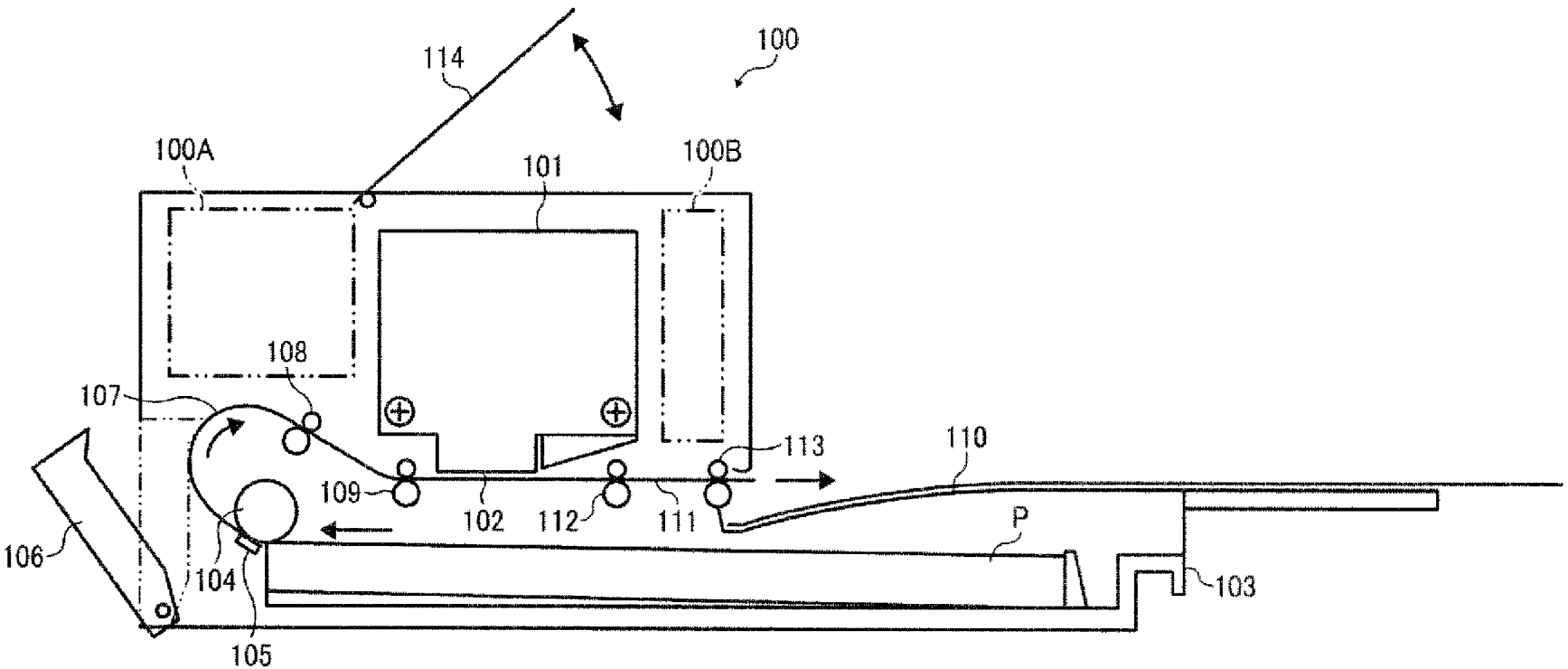
FIG. 1 illustrates a comparative example for describing a problem raised in an image forming apparatus.

A description is now given of an image forming apparatus according to embodiments of the invention. It should be noted that the recording medium referenced throughout the description can include a variety of different materials other than paper, such as fiber (e.g. textile thread), laser, metal, plastic, glass, wood, ceramics, etc., enabling adhesion or penetration of liquid drops other than the recording sheet. Referring now to the drawings, wherein like reference numerals designate identical or corresponding parts throughout the several views thereof, and in particular to FIG. 3 and subsequent drawings.

Figure 3:
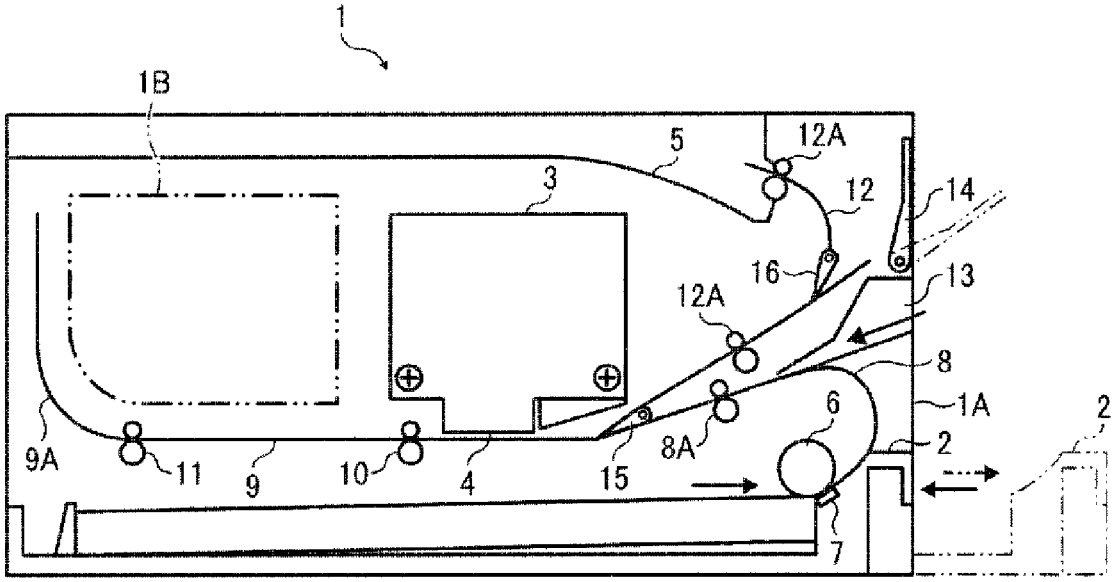
FIG. 3 illustrates a substantial configuration of an image forming apparatus according to one embodiment of this disclosure.
Figure 4:
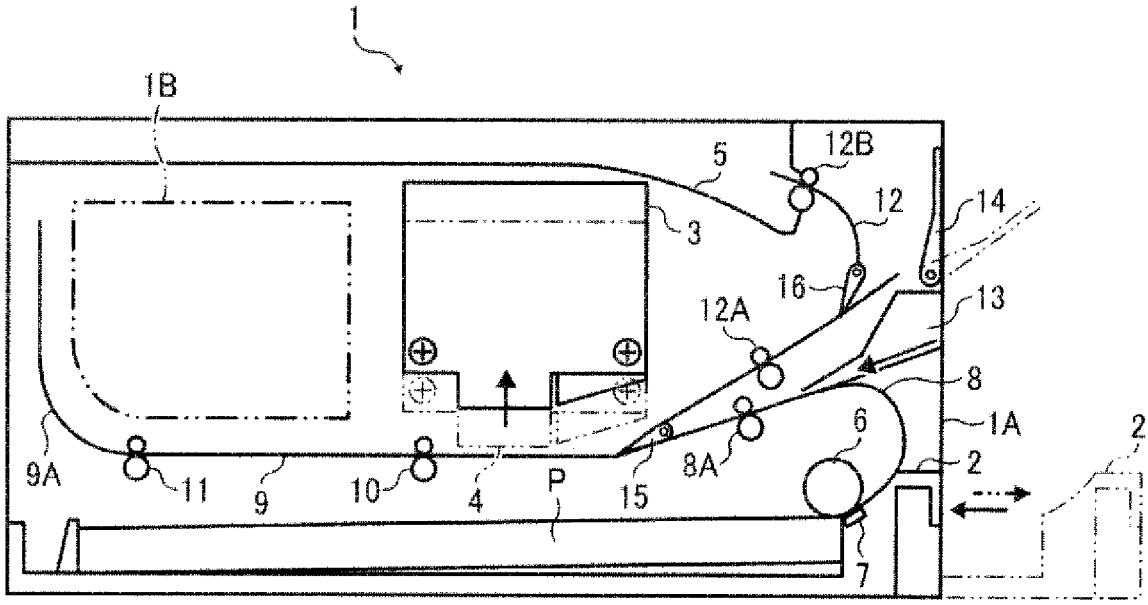
FIG. 4 illustrates an aspect of a printing unit employed in the substantial configuration of FIG. 3.

As shown in FIG. 3, an image forming apparatus employs a similar configuration of the ink jet printing system of FIG. 1, in which a sheet feeding cassette is detachably attached to an apparatus body in a longitudinal direction thereof (i.e., left and right directions in the drawing). An ink jet printing system 1 of this embodiment includes the sheet feeding cassette 2 detachably attached to a lower section of the apparatus body, a printing unit composed of a liquid droplet ejection device 3 that executes printing onto a recording sheet P fed from the sheet feeding cassette 2, and a platen glass 4 (herein after sometimes collectively referred to as a printing unit 3). The liquid droplet ejection device 3 employed in the printing unit is enabled to rise and fall as shown in FIG. 4 to separate from the conveyance path, for example, to deal with jamming of a recording sheet P when jamming occurs thereon. However, the present invention can be applied to a system having a stable liquid droplet ejection device 3 that does not rise and fall different from the above-described embodiment. The sheet feeding cassette 2 is designed to have an feeding position at the front side of the apparatus body (i.e., on a right side in the drawing) (in a longitudinal direction (i.e., left and right side direction in the drawing)) and is capable of accommodating a stack of recording sheets P with it's a lengthwise direction being consistent with the detachably attached direction thereof.

At such a feeding position of the recording sheet P, there are provided a feeding roller 6 that contacts the topmost recording sheet P and a separator 7 composed of a friction pad opposed to and contacting the feeding roller 6 to separate recording sheet P miss fed by the feeding roller 6 with friction. Between the feeding position of the recording sheet P fed from the sheet feeding cassette 2 and the printing unit 3, there is provided a conveyance path 8 having a pair of conveyance rollers 8A for conveying the recording sheet thus fed toward the printing unit 3 with the recording sheet P being turned down in the longitudinal direction of the apparatus body.

Further, a switchback conveyance path 9 is provided at a position where the recording sheet P passes through the printing unit 3 so as to convey a printed sheet P in a direction opposite to that the recording sheet P has been conveyed toward the printing unit 3. For this reason, the switchback conveyance path 9 includes two pair of rollers 10 and 11 each rotatable in both directions. Further, a tail end of the switchback conveyance path 9 is capable of moving the recording sheet P keeping its conveyance direction as passing through the printing unit 3. Such a switchback conveyance path 9 is formed from a diversion conveyance path 9A diverted upwardly in the vicinity of one end of the recording sheet P in the conveyance direction when the recording sheet P passes through the printing unit 3. A length of the round around conveyance path 9A is predetermined in a prescribed range so that of the longest recording sheet P can be conveyed in an opposite direction with the recording sheet P being sandwiched by one of the two pair of rollers 10 and 11 when one end of the longest recording sheet P reaches thereto after being fed from the printing unit 3. Further, each of the two pair of rollers 10 and 11 has a star shape circumference to reduce friction damage on an image born on the printed sheet P.

Hence, with provision of such a round around conveyance path 9A, it can be conveyed in the opposite direction after the recording sheet P has passed through the recording sheet 3, while suppressing the conveyance length within the length of the sheet feeding cassette 2 even if the longest recording sheet P is printed. Consequently, a space occupied by the conveyance path extending in parallel to (a lengthwise direction of) the sheet feeding cassette 2 (i.e., a length along the detachably attached direction of the sheet feeding cassette 2), is suppressed not to exceed the length of the sheet feeding cassette 2. Further, an installation space 1B for installing the electric components is arranged within a horizontal range where the recording sheet P extends from the printing unit 3 ending at the round around conveyance path 9A.

Further, between the switchback conveyance path 9 and the sheet ejection tray 5, there is provided a front and back side inversion conveyance path 12 having two pair of conveyance rollers 12A and 12B for conveying a printed sheet P, passing through the switchback conveyance path 9, with its printed surface printed in the printing unit facing downward, i.e., in a face down state, onto the sheet ejection tray 5.

As shown, the front and back sides inversion conveyance path 12 flows together with the conveyance path 8 extending from the sheet feeding cassette 2 to the printing unit 3 and ejects the recording sheet P when it is fed from the switchback conveyance path 9 and travels forward. Consequently, a printed surface of the recording sheet P ejected onto the sheet ejection tray 5 is directed downward thereby capable of avoiding the exposure thereof to an outside. At the same time, the recording sheets P are ejected in such a manner that the printed order is consistent with the page number order.

Similar to the conveyance path 8 having the feeding position where the recording sheet P is fed from the sheet feeding cassette 2, the front and back sides inversion conveyance path 12 has a folding back section in the front side of the apparatus body. Further, a wall unit 1A of the front side is connected to the apparatus body via a hinge at its portion and is openably closable in relation to the apparatus body as shown in FIGS. 5 to 7.

Figure 5:
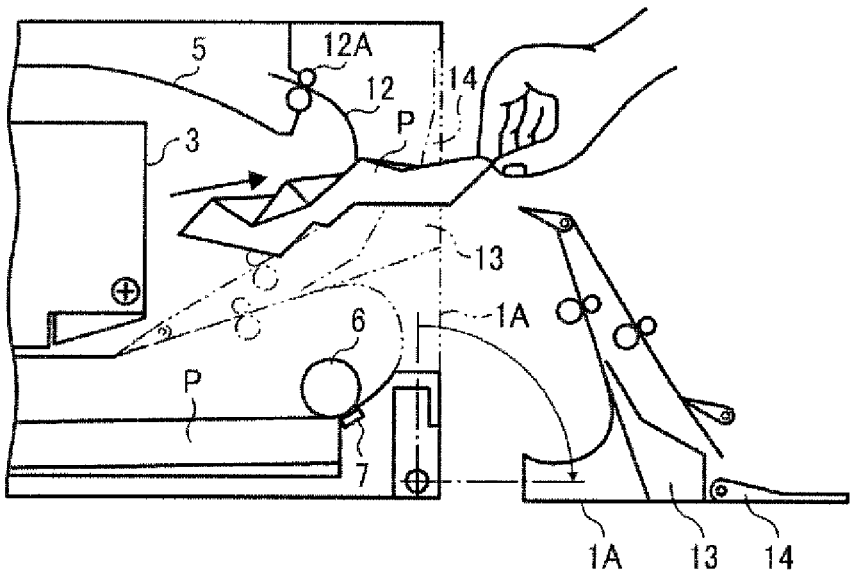
FIG. 5 illustrates one of functions of the substantial configuration of FIG. 3.

Specifically, as shown in FIG. 5, in the opening state of the wall unit 1A, a recording sheet P jamming either on the conveyance path 8 or in a range between the printing unit 3 and the front and back side inversion conveyance path 12 can be fed therefrom. More specifically, as shown in FIG. 7, when the wall unit 1A is opened, the printing unit 3 and the conveyance path are partially exposed to the outside as a status ready for extracting the jamming recording sheet P therefrom. In the drawing, reference numeral 18 denotes an ink cartridge.

Back to FIG. 3, there are provided a bypass sheet feeding unit 13 and a bypass sheet ejection unit 14 positioned above the bypass sheet feeding unit 13 are provided on a wall unit provided in the front side of the apparatus body.

Figure 6:
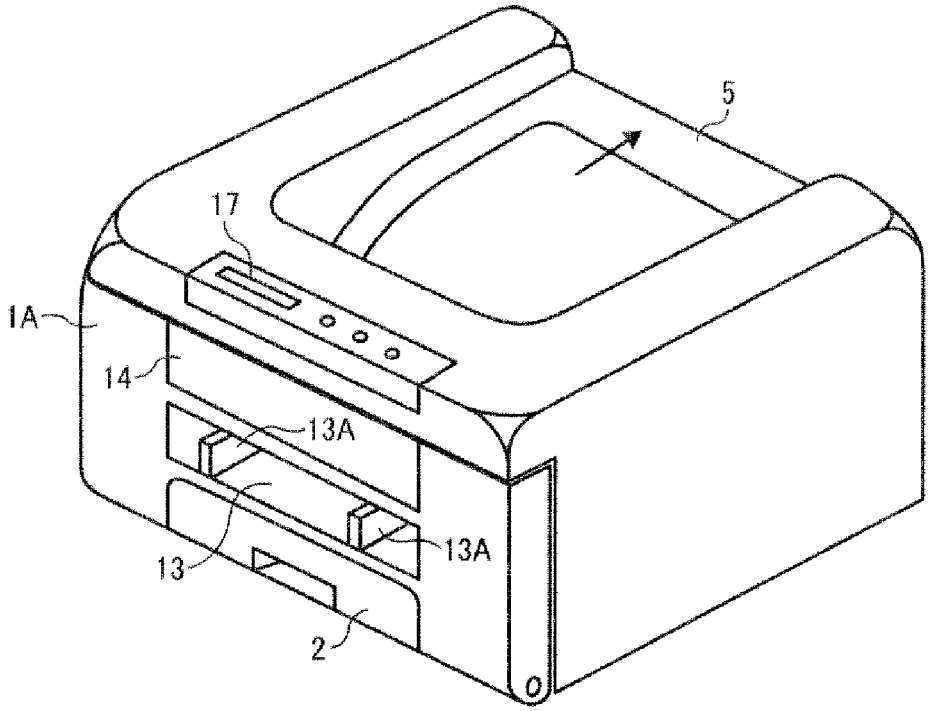
FIG. 6 schematically illustrates an exterior appearance of an image forming apparatus according to one embodiment of this disclosure.
Figure 7:
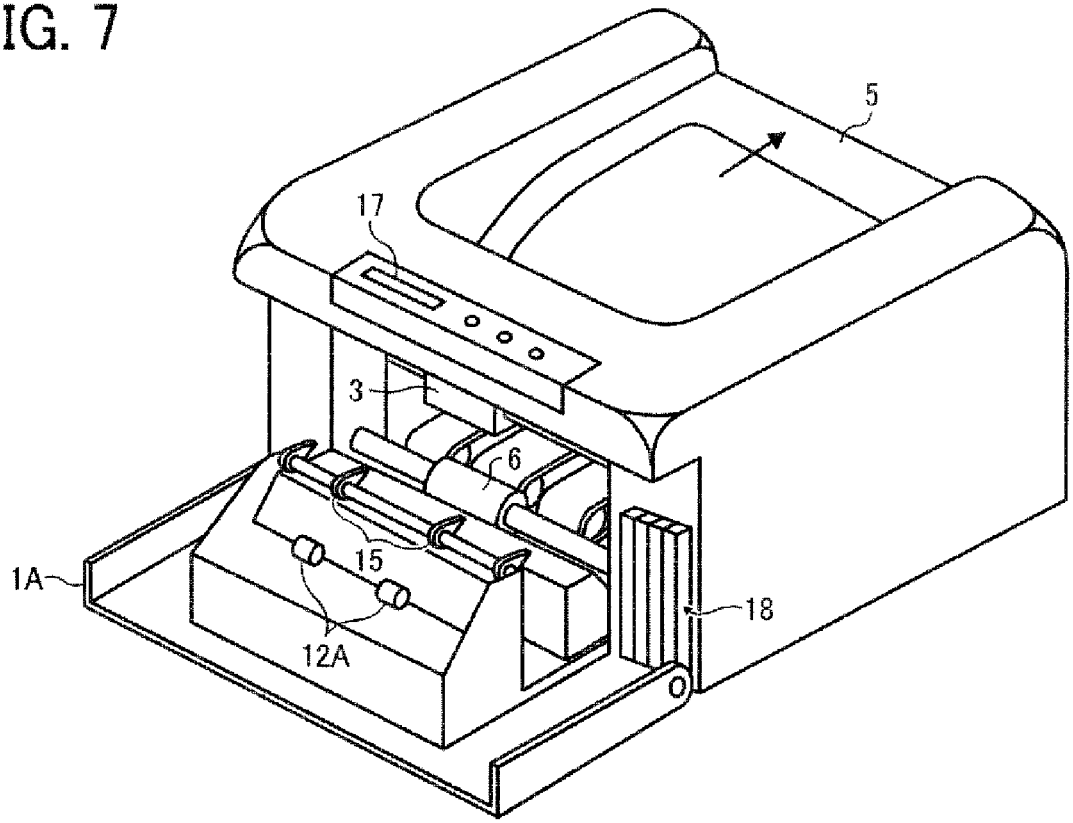
FIG. 7 illustrates an aspect of the image forming apparatus of FIG. 6.

Specifically, the ink jet printing system has the bypass sheet feeding unit 13 and the bypass sheet ejection unit 14 as illustrated in FIG. 6. Back again to FIG. 3, the bypass sheet ejection unit 14 is formed from an openably closable tray attached to the wall unit. Further, as shown in FIG. 6, the bypass sheet feeding unit 13 is formed from an opening and a side end guide 13A slidable in a widthwise direction. In FIG. 6, 17 denotes an operation panel.

As shown in FIG. 3, a path of the bypass sheet feeding unit 13 flows together with the conveyance path 8 extending from the sheet feeding cassette 2. The bypass sheet ejection unit 14 branches off from the front and back side inversion conveyance path 12.

Further, as described above, a switching device for switching a direction of conveyance of a recording sheet P is provided at each of confluences in this embodiment.

Specifically, as shown in FIG. 3, at the confluence of the conveyance path 8 and the front and back side inversion conveyance path 12, there is provided a bifurcation member 15 for switching a direction of the recording sheet P either from the conveyance path 8 to the printing unit 3 or from the printing unit 3 to the front and back side inversion conveyance path 12.

Figure 8:
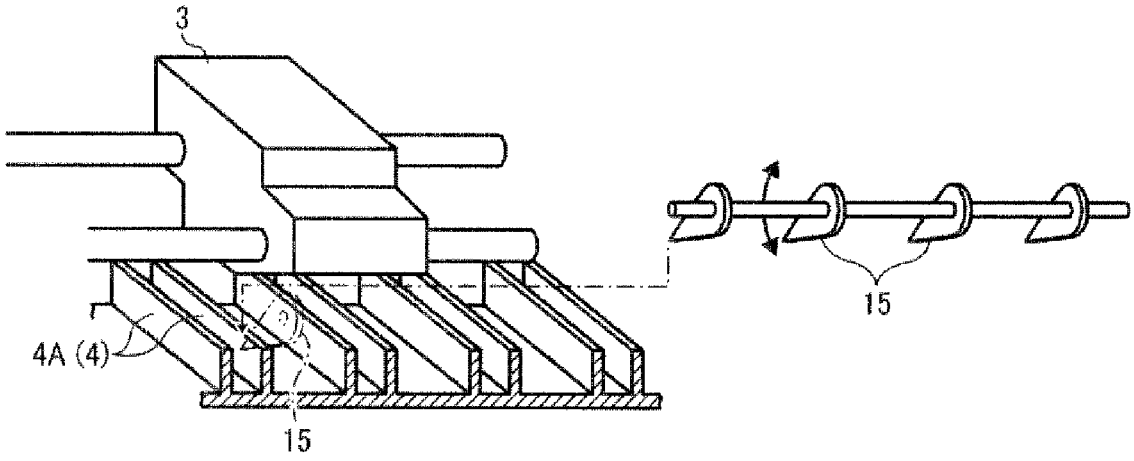
FIG. 8 illustrates an aspect of a member used as a bifurcation structure shown in FIG. 3.

The bifurcation member 15 is composed of a bifurcation pick swingable to designate the above-described conveyance directions, and enabled to enter between ribs 4 included in the platen grass 4 opposed to the printing unit 3 as shown in FIG. 8. The neighboring ribs 4A receiving the bifurcation member 15 therebetween have a narrower interval than others to suppress dropping or hooking of the recording sheet P thereinto.

Figure 9A:
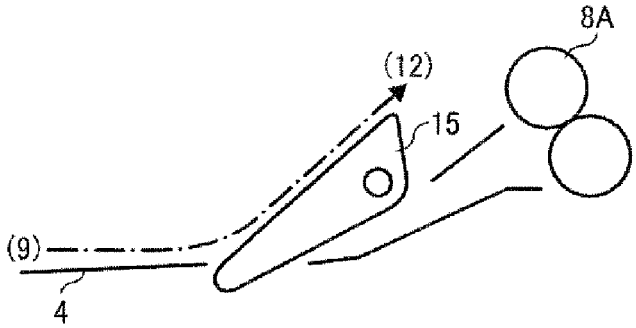
FIGS. 9A and 9B collectively illustrate a configuration and a function of a bifurcation member used as the bifurcation structure of FIG. 8.
Figure 9B:
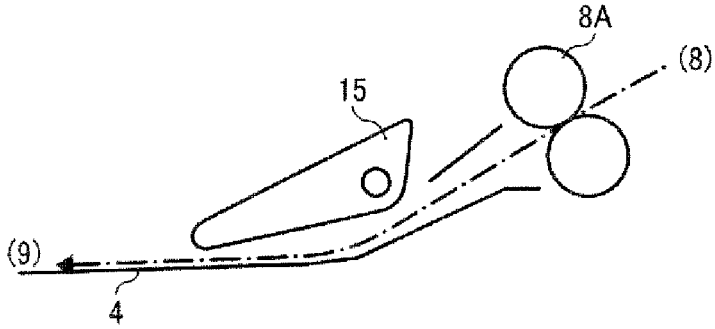

Further, at another confluence where the front and back side inversion conveyance path 12 flows together with a path of the bypass ejection unit 14, there is provided a swingable sheet ejection switching member 16 that switches a conveyance direction of the recording sheet P either to the sheet ejection tray 5 or the bypass sheet ejection unit 14. Now, a function of the bifurcation member 15 serving as one of switching members that switches the conveyance direction is described with reference to FIGS. 9A and 9B. Specifically, a condition in which a conveyance direction of a recording sheet P is switched by the bifurcation member 15 from the printing unit 3, accordingly the switchback conveyance path 9 (see FIG. 9), to the front and back side inversion conveyance path 12 is illustrated in FIG. 9A. Whereas, another condition in which the conveyance direction of the recording sheet P is switched by the bifurcation member 15 from the conveyance path 8 to the printing unit 3, accordingly the switchback conveyance path 9 (see FIG. 9), is illustrated in FIG. 9B.

Further, as shown in FIG. 9A, when a swinging end of the bifurcation member 15 enters the rib of the platen glass unit 4, a recording sheet P traveling from the printing unit 3 to the front and back side inversion conveyance path 12 can be scooped up with the bifurcation member 15. Further, when the recording sheet P rises from the ribs of the platen unit 4, the bifurcation member 15 can press the moving recording sheet P against the conveyance path 8. Since the recording sheet P is already pressed against the conveyance path 8 before entering the printing unit 3 when the bifurcation member 15 takes the position of FIG. 9B, jamming thereof at the printing unit 3 due to unexpected collision can be suppressed. To better appreciate the unique advantages of the configuration described above, a description is now given of comparative examples of an image forming apparatus with reference to FIGS. 1 and 2.

As shown, the comparative image forming apparatus is an ink jet printing system that includes a liquid drop ejection device 101 for ejecting ink, and a platen glass 102 in a printing unit (herein after sometimes referred to as a printing unit for the sake of convenience). A front side of the ink jet printing system 100 corresponds to the left side in the drawing. In the ink jet printing system 100, there is provided a sheet feeding cassette 103 detachably attached to a lower section thereof having an opening for replenishing sheets at its front side. Therefore, the sheet feeding cassette 103 is enabled to feed a recording sheet P from the rear side thereof that is the rear side in the ink jet printing system 100 (i.e., a left side in the drawing). At an feeding position where the recording sheet P is fed, there is provided a separation unit 105 composed of an feeding roller 104 that contacts the topmost recording sheet P stacked on the sheet feeding cassette 103 and a friction pad upwardly contacting the feeding roller 104 being opposed thereto to separate double fed recording sheets P with friction. On a portion of a rear side wall of the system 100, there is provided an openably closable cover 106 to enable extraction of a jamming sheet jamming at the feeding section when it is opened.

Further, between the feeding position of the sheet feeding cassette 103 and a liquid drop ejection device 101, there are provided a conveyance unit 107 composed of an inversion path, a pair of conveyance rollers 108, and a pair of holding rollers 109 for holding the recording sheet P at upstream of the printing unit.

In the vicinity of the liquid drop ejection device 101 employed in the printing unit, there is provided an ejection path 111 for ejecting and conveying the printed sheet P toward an sheet ejection tray 110 provided above the sheet feeding cassette 103 at the front side of the system. The printed sheet P is therefore ejected toward the sheet ejection tray 110 via a pair of ejection sheet conveyance rollers 112 and a pair of ejection rollers 113 keeping its conveyance direction to the printing unit. The ink jet printing system 100 further includes an openably closable cap cover 114 on a body of the system to allow insertion of hand of an operator toward a conveyance path provided in the system.

Accordingly, with the above-described configuration, when a recording sheet P fed from the sheet feeding cassette 103 and conveyed toward the sheet ejection tray 110 jams on the conveyance path therebetween, the jamming recording sheet P is removed by opening the cover 106 or the cap cover 114 positioned at the rear side thereof and inserting the hand into the system therethrough. However, with such a configuration, since the cover 106 is positioned at the rear side of the system, visibility and usability significantly deteriorate when removing the jamming recording sheet P as different from the front side recovery operation. As a position that likely causes sheet jamming beside the feeding position of the sheet feeding cassette 103, an entering position where a recording sheet starts entering the printing unit is exemplified. Specifically, when a leading end of the recording sheet P happens to rise at the entering position, the leading end thereof collides with the printing unit thereby causing the sheet jam.

In such a situation, a hand insertion unit allowing hand insertion can be provided in the configuration of FIG. 1 to deal with the sheet jamming at the front side of the system. However, since there are sometimes provided an installation spaces 100A and 100B for accommodating electric components and a structure maintaining rigidity of an interior of the system around the printing unit in the system, respectively, the above-described hand insertion and removal of the jamming sheet are hardly performed. For this reason, the operation is executed from an upper surface of the system by using the cap cover 114, for example.

However, even though such a configuration can improve the visibility and the usability indeed greater than the rear side recover operation, the usability is yet worse than the front side recovery operation, because the recovery operation is performed distanced from the front side. Further, when it is fed from the sheet feeding cassette 103 and passes through the printing unit with it being inverted, the recording sheet is ejected onto the sheet ejection tray 110 with its printed surface facing upward thereon. Consequently, the subsequent recording sheets are similarly stacked on the printed surface of the previously ejected recording sheet, and as a result, a printed order becomes inconsistent with a page number order of those. At the same time, since printed contents are exposed to an outside, security thereof is poor.

Hence, according to the configuration of FIG. 1, the problems of low usability in dealing with the sheet jamming and inconsistency of printing and ejection orders of the recording sheet occur.

Now, another comparative configuration is described with reference to FIG. 2. Different from that of FIG. 1, this configuration employs a vertical conveyance system for conveying the recording sheet fed from the sheet feeding cassette 103. Specifically, the conveyance path for conveying the recording sheet starts from the feeding position of the recording sheet at the sheet feeding cassette 103 and ends at the sheet ejection tray 110 via the printing unit, and is arranged on the front side of the system. A front side wall is provided on the front side of the system and is openably closable to expose the conveyance path to the outside thereof.

Figure 2:
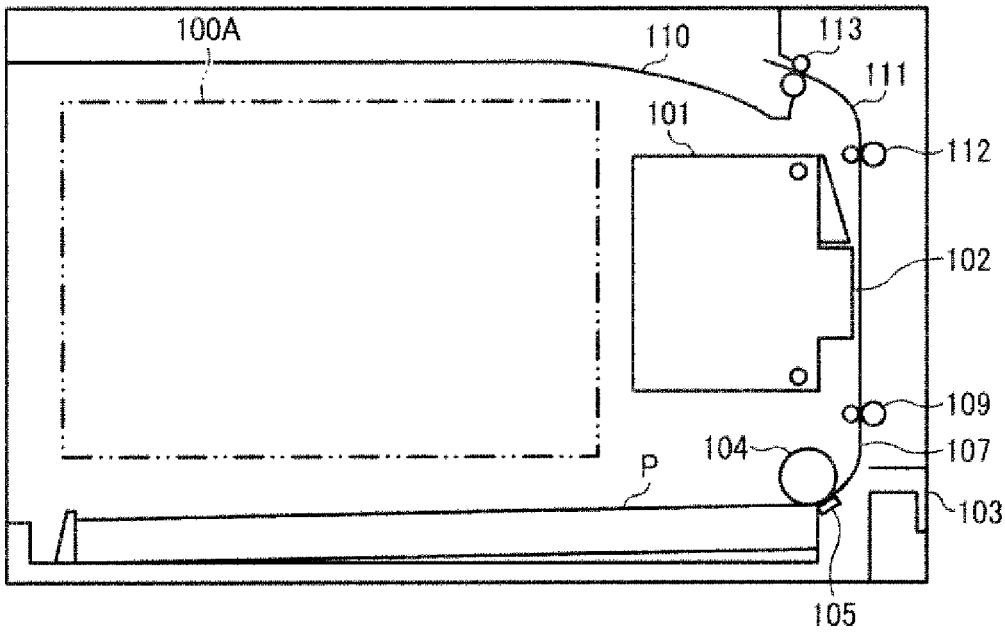
FIG. 2 illustrates another comparative example for describing another problem raised in an image forming apparatus.

However, with such a configuration having a vertical conveyance path passing through the printing unit, even though a space horizontally occupied by the printing unit can be minimized, since the sheet feeding cassette 103 needs a prescribed length corresponding to a length of the recording sheet accommodated therein (i.e., a length in an feeding direction), a space horizontally occupied (by the sheet feeding cassette 103) (i.e., a space 100A located on a back side of the printing unit 101 in FIG. 2) becomes greater than that horizontally occupied by the printing unit 101. In addition, owing to the vertical conveyance path, the installation space 100A for installing the electric component around the printing unit becomes greater, thereby provably becoming a taller system needlessly. In such a situation, a curvature radius of a folding down section of the vertical conveyance path can be made smaller at the feeding position of the sheet feeding cassette 103 and a side of the sheet ejection tray 114 among the entire vertical conveyance path to minimize the height thereof However, damage on a printing surface is serous such that an image partially disappears or the like due to rubbing. Hence, according to the image forming apparatuses of FIGS. 1 and 2, problems of excessive installation space and serious damage on the recording sheet remain unsolved.

By contrast, according to this embodiment, since the folding back configuration in the longitudinal direction of the apparatus body is employed in both of the conveyance path 8 extending from the sheet feeding cassette 2 to the printing unit 3 and the front and back side inversion conveyance path 12 extending from the switchback conveyance path 9 to the sheet ejection tray 5, the height of the apparatus body does not unnecessarily increase.

Further, the switchback conveyance path 9 for returning the recording sheet P coming from the printing unit 3 in a switchback direction has a roundabout way at its tail end, while the other portion of the conveyance path 9 is located within a region of the lengthwise end of the sheet feeding cassette 2, an installation area for the apparatus body can substantially accommodate the length of the sheet feeding cassette 2. Consequently, the installation space can be suppressed not to unnecessarily become wider.

Further, since the recording sheet P conveyed toward the printing unit 3 is lead to the switchback conveyance path 9 after passing through the printing unit 3, it can stay for a certain time period within the apparatus body after printing. Accordingly, even a hardly dehydrating recording sheet is used as a printing objective, it can sufficiently dehydrate by earning a relatively long time period between completion of printing and ejection of the recording sheet P onto the sheet ejection tray. Hence, a user does not erroneously extract the printing result minimizing damage on a recording sheet. Further, when a recording sheet P is temporarily stopped as a standby state on the switchback conveyance path 9 after completion of printing, it can be ejected only when a user approaches the apparatus body to extract thereof, thereby the security can be more improved. The security is also improved at the same time by inverting and directing a printing surface of the recording sheet P downward using the front and back side inversion conveyance path 12.

Further, when sheet jamming occurs on the conveyance path in the apparatus, by opening the wall unit 1A of the front side of the apparatus, an feeding position of the sheet feeding cassette 2, the recording unit 3, the front and back side inversion conveyance path 12 extending up to the sheet ejection tray 5 are exposed at the front side in the apparatus. Accordingly, since the jamming problem can be solved by recovery operation accessing only in a prescribed direction thereto with good visibility, the usability can be promoted. Especially, since the printing unit 3 is enabled to separate from the conveyance path conveying the recording sheet P when the recording sheet P jams thereon, extraction performance extracting jamming recording sheet P can be further promoted.

Now, another embodiment of this disclosure is described with reference to FIG. 10. In an image forming apparatus of this embodiment, a member conveying a recording sheet is commonly used as described below in detail.

Figure 10:
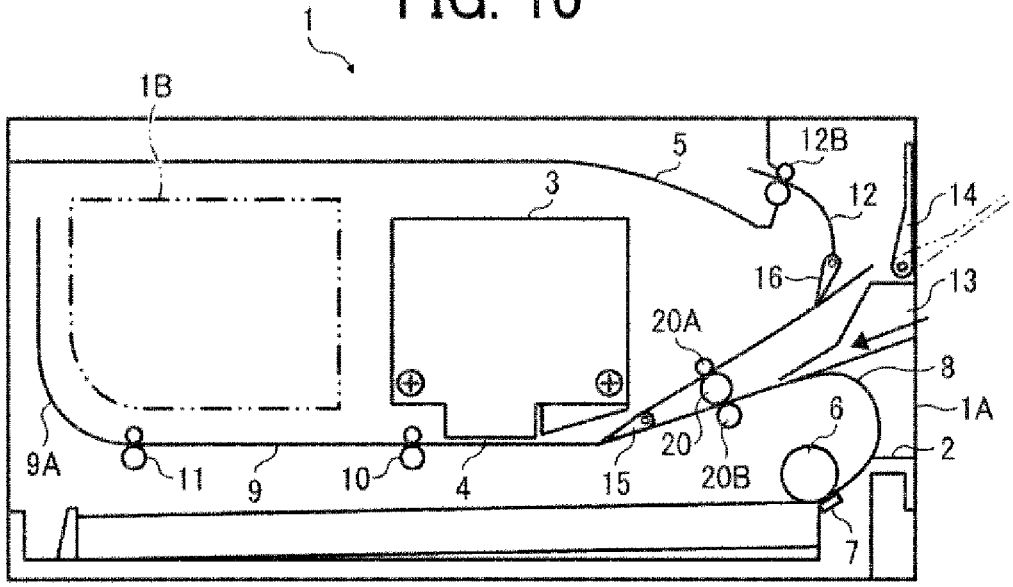
FIG. 10 illustrates a partial modification of the substantial configuration of FIG. 3.

Specifically, as shown in FIG. 10, one of the pair of sheet feeding rollers is arranged both in the conveyance path 8 and the front and back side inversion conveyance path 12 and is commonly used to convey the recording sheet P to prescribed directions. More specifically, as shown, the sheet feeding roller 20 is arranged between the conveyance path 8 and the front and back side inversion conveyance path 12, while opposing rollers 20A and 20B capable of conveying the recording sheet P by sandwiching it with the sheet feeding roller 20 are arranged opposed there to. Hence, the sheet feeding roller 20 functions as a commonly used roller to rotate each of the opposed rollers 20A and 20B in both directions, thereby conveying the recording sheet P in different directions on respective conveyance paths. As a result, the numbers of parts to be provided on the conveyance path can be decreased at low cost. Different from a system where two pair of sheet feeding rollers are respectively employed in both conveyance paths, a vertical interval between these conveyance paths can be decreased, a surplus space can be obtained in a vertical direction.

Now, yet another modification of the above-described embodiment is described with reference to FIG. 11.

As shown, a modified bifurcation member 15' is employed. The bifurcation member 15' is composed of Mylar (TM) having flexibility and is fixed to the apparatus body adjacent to the conveyance path at its one end in a cantilever like state.

Figure 11A:
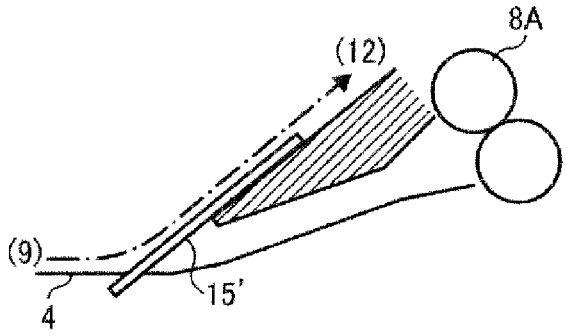
FIGS. 11A and 11B collectively illustrate a configuration and a function of a modification obtained by modifying the substantial part of the bifurcation structure of FIG. 9.

Further, as shown in FIG. 11A, a free end of the bifurcation member 15' is arranged protruding to the platen unit 4 in an initial state. Therefore, when the recording sheet P traveling toward the printing unit 3 from the conveyance path 8 pushes the bifurcation member 15', the free end can bend and deform parting from the platen unit 4 as shown in FIG. 11B.

Figure 11B:
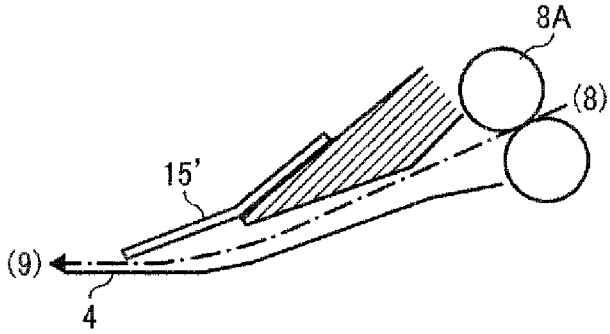

According to this embodiment, when the recording sheet P travels toward the printing unit 3 from the conveyance path 8 as shown in FIG. 11B, the recording sheet P is depressed by the bifurcation member 15' in the initial state and does not rise thereon. Whereas, when the recording sheet P travels toward the front and back side inversion conveyance path 12 as shown in FIG. 11A, the bifurcation member 15' can scoop the leading end of the recording sheet P up and successfully guide it in a prescribed direction.

Figure 12:
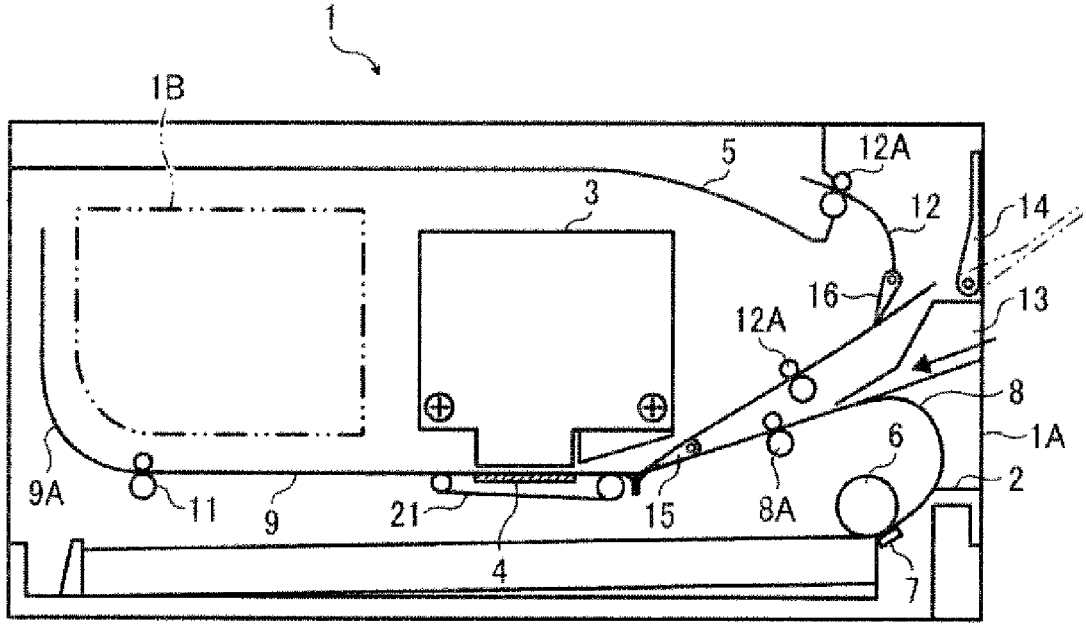
FIG. 12 illustrates a modification of a configuration of the printing unit of FIG. 3.

Now, yet another modification of the above-described embodiment is described with reference to FIGS. 12 and 13, wherein the printing unit 3 of the formed embodiment is modified. A loop state conveyance belt 21 is newly provided in the platen unit 4 as shown in FIG. 12. Further, this embodiment generates a negative pressure in an inner space of the loop of the conveyance belt 21 to provide the negative pressure to a surface of the conveyance belt, so that the conveyance belt can absorb and convey the recording sheet P at it circulates. Hence, since the recording sheet P travels being sucked to the conveyance belt 21, the recording sheet P does not slide contacting thereon. As a result, an image is not damaged generally caused by the sliding contact on the printing unit 3.

Figure 13:
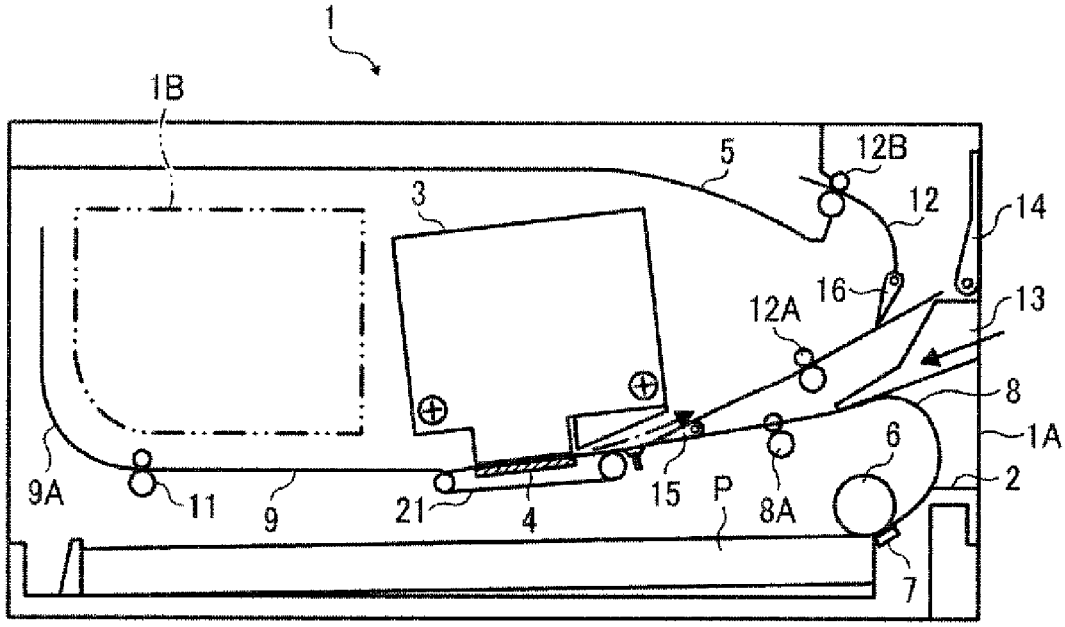
FIG. 13 illustrates another modified configuration of the printing unit of FIG. 3.

Further, as shown in FIG. 13, the printing unit 3 and a stretching direction of the conveyance belt 21 provided in the platen unit are inclined along an extension line extending from either the conveyance path 8 or the front and back side inversion conveyance path 12. Hence, with such a configuration, a conveyance path connecting either the conveyance path 8 or the front and back side inversion conveyance path 12 with the printing unit 3 can be linear. Consequently, when a thick recording sheet is conveyed from the bypass sheet feeding unit 13, conveyance performance can be improved by decreasing the numbers of curved paths during its conveyance. Further, by increasing a curvature radius at a folding back position on the front and back side inversion conveyance path 12, sheet jamming can be more suppressed.

The printing unit 3 can be inclined for the same purpose when the stable ribs of FIGS. 3 and 8 are employed in the platen unit 4 instead of the conveyance belt.

According to one embodiment of this disclosure, since both of the conveyance unit and the front and back side inversion conveyance unit are folded back to invert the recording sheet P in the longitudinal direction of the apparatus body, a height of the apparatus can be minimized. Further, according to one embodiment of this disclosure, since the printed sheet switches back after being printed, a switchback conveyance unit can be included within a longitudinal length of the sheet feeding cassette, thereby substantially eliminating a wasted space in the longitudinal direction of the apparatus.

Further, according to one embodiment of this disclosure, since both of the sheet feeding position of the conveyance unit and the front and back side inversion conveyance unit are arranged in the front side of the image forming apparatus, sheet jamming recovery can be performed from one side (i.e., a front side of the apparatus) keeping good usability.

Further, according to one embodiment of this disclosure, since the recording sheet passing through the switchback conveyance unit is inverted with its printed surface being upside-down before being ejected onto the sheet ejection tray, an ejection order becomes consistent with a page number order. At the same time, since the printed surface is invisible from an outside, good security can be maintained.

Numerous additional modifications and variations of the present invention are possible in light of the above teachings. It is therefore to be understood that within the scope of the appended claims, the present invention may be practiced otherwise than as specifically described herein.

What is claimed is:

1. An image forming apparatus comprising:

a main body;

a sheet feeding cassette to accommodate recording sheets, the sheet feeding cassette detachably attached to the main body in a back and forth direction of the main body;

a printing unit to execute printing onto the recording sheet fed from the sheet feeding cassette;

a sheet ejection tray to receive a printed sheet from the printing unit;

a first conveyance unit to feed a recording sheet from a front side of the sheet feeding cassette at a sheet feeding position, the first conveyance unit including a reversing path between the sheet feeding position and the printing unit for turning the recording sheet fed from the sheet feeding cassette upside down and conveying the recording sheet to the printing unit along the reversing path;

a switchback conveyance unit to convey the recording sheet in an opposite direction to that in which the recording sheet is conveyed via the reversing path to the printing unit after a printing process executed by the printing unit, the switchback conveyance unit defining a switchback conveyance path extending from the printing unit to guide the recording sheet switching back toward the sheet ejection tray; and a front and back side inversion conveyance unit to turn the recording sheet coming from the switchback conveyance path upside down, the front and back side inversion conveyance unit defining an inversion path guiding the recording sheet to the sheet ejection tray with a printed surface of the recording sheet facing down thereon, wherein both of the reversing path of the first conveyance unit and the inversion path of the front and back side inversion conveyance unit are disposed at the front side in the image forming apparatus.

2. The image forming apparatus as claimed in claim 1, wherein the switchback conveyance path of the switchback conveyance unit has a detour extending vertically within the main body downstream of the printing unit.

3. The image forming apparatus as claimed in claim 1, further comprising an at least partially openably closable front side wall unit to allow access to the feeding position of the conveyance unit and the front and back side inversion conveyance unit when the front side wall unit is opened.

4. The image forming apparatus as claimed in claim 3, wherein the at least partially openably closable front side wall unit comprises:

a bypass sheet feeding unit to feed a recording sheet from a source other than the sheet feeding cassette, the bypass sheet feeding unit defining a bypass path converging with the reversing path of the first conveyance unit extending from the sheet feeding cassette; and a bypass sheet ejection unit to eject the recording sheet onto a destination other than the sheet ejection tray, the bypass sheet ejection unit having a bypass sheet ejection path branching off from the inversion path of the front and back side inversion conveyance unit.

5. The image forming apparatus as claimed in claim 3, wherein the at least partially openably closable front side wall unit further comprises a sheet ejection destination switching device disposed at a second confluence where the inversion path of the front and back side inversion conveyance unit and the bypass sheet ejection path of the bypass sheet ejection unit converge, the sheet ejection destination switching device switches a conveyance direction of the recording sheet from a sheet ejection tray side to a bypass sheet ejection unit side and vice versa in accordance with a printing mode.

6. The image forming apparatus as claimed in claim 3, wherein the bypass sheet ejection unit comprises:

a bypass sheet ejection path branching off from the inversion path of the front and back side inversion conveyance unit; and an openably closable bypass cover attached to the at least partially openably closable front side wall unit to provide an extension path connecting to the bypass sheet ejection path when it is opened.

7. The image forming apparatus as claimed in claim 1, further comprising a bifurcation member disposed at a first confluence where the reversing path of the first conveyance unit and the switchback conveyance of the switchback conveyance unit converge, the bifurcation member switching a conveyance direction of the recording sheet from a printing unit side to a front and back side inversion conveyance unit side and vice versa in accordance with printing progress.

8. The image forming apparatus as claimed in claim 7, wherein the bifurcation member is made of a flexible material made from a polyethylene terephthalate resin and is fixed to the apparatus body adjacent to the conveyance path at a first, fixed end in a cantilevered state, a second, free end of the bifurcation member opposite the fixed end protruding toward a platen unit and deformable away from the platen unit by a recording sheet traveling toward the printing unit from the conveyance path.

9. The image forming apparatus as claimed in claim 1, further comprising a platen unit, wherein a loop state conveyance belt is provided to the platen unit.

10. The image forming apparatus as claimed in claim 1, further comprising a pair of sheet feeding rollers to sandwich and convey the recording sheet at least in two directions, the pair of sheet feeding rollers having:

a common roller arranged between the reversing path of the first conveyance unit and the inversion path of the front and back side inversion conveyance unit to be commonly used by the first conveyance unit and the front and back side inversion conveyance unit; and at least two opposed rollers respectively arranged on the reversing path of the first conveyance unit and the inversion path of the front and back side inversion conveyance unit, the at least two opposed rollers respectively engaging the common roller from opposite sides.

11. An image forming apparatus comprising:

a main body;

means for accommodating recording sheets detachably attached to the main body in a back and forth direction of the main body;

means for printing onto a recording sheet fed from the recording sheet accommodating means;

means for receiving a printed sheet ejected from the printing means;

first means for feeding a recording sheet from a front side of the recording sheet accommodating means at a sheet feeding position, the first means including a reversing path between the sheet feeding position and the printing means for turning the recording sheet fed from the recording sheet accommodating means upside down and conveying the recording sheet to the printing means along the reversing path;

second means for conveying the recording sheet in an opposite direction to that the recording sheet is conveyed via the reversing path to the printing means after a printing process executed by the printing means, the second means having a switchback conveyance path extending from the printing means to guide the recording sheet switching back toward the sheet receiving means; and third means for turning the recording sheet coming from the switchback conveyance path upside down, the third means having an inversion path guiding the recording sheet to the sheet receiving means with a printed surface of the recording sheet facing down thereon, wherein both of the sheet feeding position of the first means and the inversion path of the third means are disposed at the front side in the image forming apparatus.

12. The image forming apparatus as aimed in claim 11, wherein the second means has a detour extending vertically within the main body downstream of the printing means.

13. The image forming apparatus as claimed in claim 11, further comprising openably closable first means for allowing access to the feeding position of the first means and the third means when it is opened.

14. The image forming apparatus as claimed in claim 13, further comprising:

first bypass means for feeding a recording sheet from another source than the recording sheet accommodating means, the first bypass means having a bypass path converging with the reversing path of the first means extending from the sheet accommodating means; and second bypass means for ejecting the recording sheet onto another destination than the sheet receiving means, the second bypass means having a bypass sheet ejection path branching off from the inversion path of the third means.

15. The image forming apparatus as claimed in claim 14, wherein the second bypass means comprises:

a bypass sheet ejection path branching off from the inversion path of the third means; and means for switching an ejecting destination of the recording sheet from a side of the sheet receiving means to a side of the second bypass means and vice versa in accordance with printing mode, the ejection destination switching means being disposed at a second confluence where the inversion path of the third means and the bypass sheet ejection path of the second bypass means converge.

16. The image forming apparatus as claimed in claim 14, wherein the second bypass means comprises:

a bypass sheet ejection path branching off from the inversion path of the third means; and means for switching an ejecting destination of the recording sheet from a sheet ejection tray side to a bypass sheet ejection unit side and vice versa in accordance with a printing mode, the ejection destination switching means being disposed at a second confluence where the inversion path of the third means the bypass sheet ejection path of the second bypass means converge, the openably closable second means being attached to the openably closable first means for providing an extension path connecting to the bypass sheet ejection path when it is opened.

17. The image forming apparatus as claimed in claim 11, further comprising means for switching a conveyance direction of the recording sheet from a side of the printing means to a side of the third means and vice versa in accordance with printing progress, the switching means being disposed at a first confluence where the reversing path of the first means and the switchback conveyance path of the second means converge.

18. The image forming apparatus as claimed in claim 11, further comprising means for sandwiching and conveying the recording sheet at least in two directions, the sandwiching and conveying means having:

a common roller arranged between the reversing path of the first means and the inversion path of the third means to be commonly used by these means; and at least two opposed rollers respectively arranged on the reversing path of the first means and the inversion path of the third means, the at least two opposed rollers engaging the common roller from opposite sides, respectively.

19. An image forming apparatus comprising:

a main body;

a sheet feeding cassette to accommodate recording sheets, the sheet feeding cassette detachably attached to the main body in a back and forth direction of the main body;

a printing unit to execute printing onto the recording sheet fed from the sheet feeding cassette;

a sheet ejection tray to receive a printed sheet from the printing unit;

a first conveyance unit to feed a recording sheet from a front side of the sheet feeding cassette at a sheet feeding position, the first conveyance unit turning the recording sheet fed from the sheet feeding cassette upside down and conveying said recording sheet turned upside down to the printing unit along a first conveyance path;

a switchback conveyance unit to convey the recording sheet in an opposite direction to that in which the recording sheet is conveyed via the first conveyance path to the printing unit after a printing process executed by the printing unit, the switchback conveyance unit defining a switchback conveyance path extending from the printing unit to guide the recording sheet switching back toward the sheet ejection tray;

a front and back side inversion conveyance unit to invert the recording sheet coming from the switchback conveyance path upside down, the front and back side inversion conveyance unit defining an inversion path guiding the recording sheet to the sheet ejection tray with a printed surface of the recording sheet facing down thereon; and an at least partially openably closable front side wall unit to allow access to the sheet feeding position of the first conveyance unit and the front and back side inversion conveyance unit when the front side wall unit is opened, wherein both of the sheet feeding position of the first conveyance unit and the inversion path of the front and back side inversion conveyance unit are disposed at the front side in the image forming apparatus.

* * * * *